US008637431B2

(12) United States Patent
Stork et al.

(10) Patent No.: US 8,637,431 B2
(45) Date of Patent: Jan. 28, 2014

(54) HEAT-SENSITIVE RECORDING MATERIAL WITH REVERSE FACE COATING

(75) Inventors: Gerhard Stork, Flensburg (DE); Karsten Lerius, Munkbrarup (DE)

(73) Assignee: Mitsubishi HiTec Paper Europe GmbH, Flensburg (DE)

( * ) Notice: Subject to any disclaimer, the term of this patent is extended or adjusted under 35 U.S.C. 154(b) by 50 days.

(21) Appl. No.: 13/497,232

(22) PCT Filed: Jun. 30, 2010

(86) PCT No.: PCT/EP2010/059258

§ 371 (c)(1), (2), (4) Date: May 17, 2012

(87) PCT Pub. No.: WO2011/032738

PCT Pub. Date: Mar. 24, 2011

(65) Prior Publication Data

US 2012/0225774 A1 Sep. 6, 2012

(30) Foreign Application Priority Data

Sep. 21, 2009 (DE) ..... 10 2009 041 998

(51) Int. Cl.
*B41M 5/40* (2006.01)
*B41M 5/42* (2006.01)

(52) U.S. Cl.
CPC ..... *B41M 5/426* (2013.01)
USPC ..... 503/207; 503/226

(58) Field of Classification Search
USPC ..... 503/200–226
See application file for complete search history.

(56) References Cited

U.S. PATENT DOCUMENTS

| | | | |
|---|---|---|---|
| 4,424,245 | A | 1/1984 | Maruta et al. |
| 4,837,196 | A | 6/1989 | Ogata |
| 6,326,330 | B1 | 12/2001 | Wagner et al. |

FOREIGN PATENT DOCUMENTS

| | | |
|---|---|---|
| DE | 32 07 071 | 9/1982 |
| DE | 37 20 171 | 2/1988 |
| DE | 38 06 201 | 9/1988 |
| WO | WO 99/14056 | 3/1999 |

*Primary Examiner* — Bruce H Hess
(74) *Attorney, Agent, or Firm* — Cozen O'Connor

(57) ABSTRACT

A heat-sensitive recording material having a substrate that carries on its first side at least one heat-sensitive recording layer having at least one dye precursor and at least one color acceptor. The dye precursor and color acceptor react with one another in a color-forming manner under the action of heat. On its second side the substrate has a backcoat containing calcium carbonate. The backcoat is formed of at least two layers, a first layer is applied closer to the substrate and a second layer is applied farther from the substrate. The first layer contains a first calcium carbonate and the second layer contains a second calcium carbonate that differs from the first calcium carbonate.

17 Claims, 1 Drawing Sheet

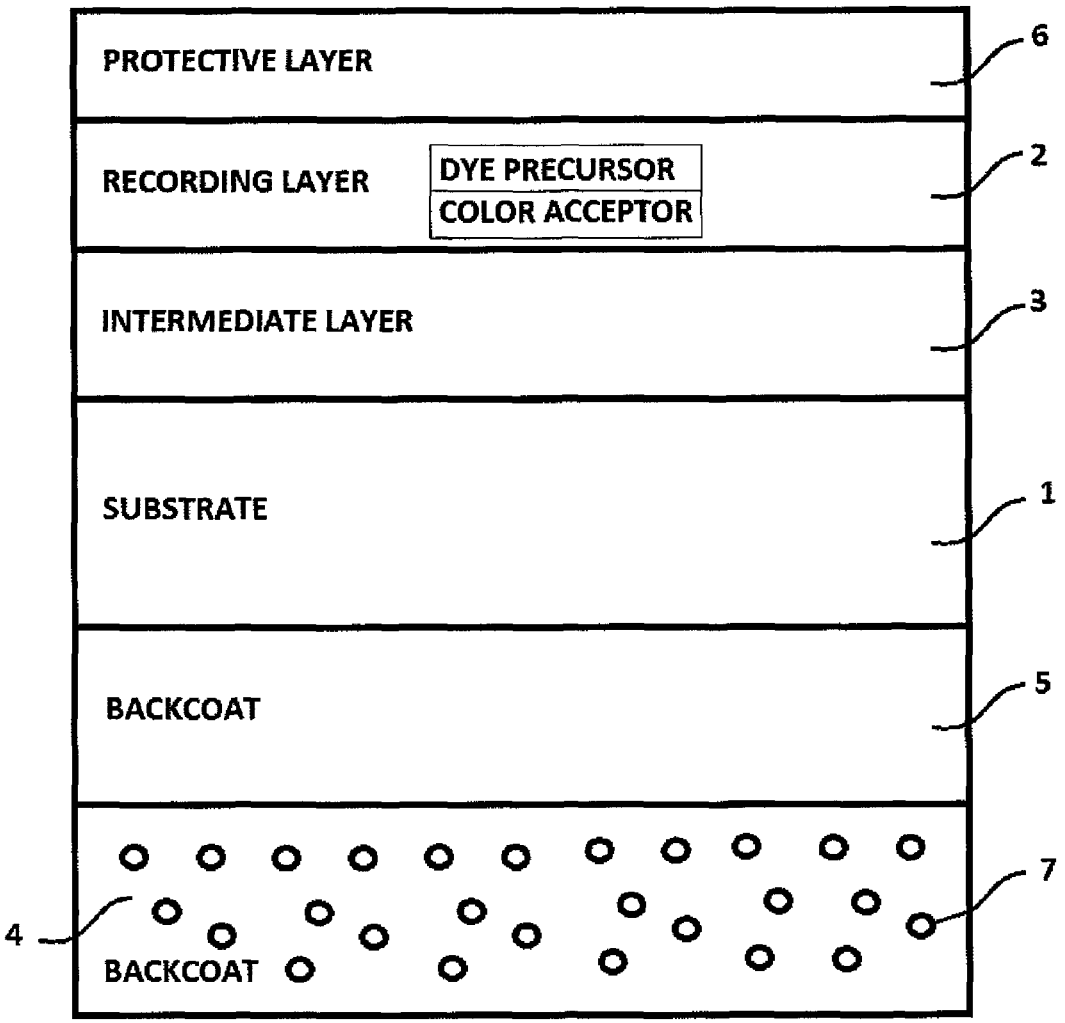
PROTECTIVE LAYER
6
RECORDING LAYER
DYE PRECURSOR
COLOR ACCEPTOR
2
INTERMEDIATE LAYER
3
SUBSTRATE
1
BACKCOAT
5
4
BACKCOAT
7

HEAT-SENSITIVE RECORDING MATERIAL WITH REVERSE FACE COATING

CROSS REFERENCE TO RELATED APPLICATIONS

This is a U.S. national stage of application No. PCT/EP2010/059258, filed on 30 Jun. 2010. Priority is claimed on German Application No. 10 2009 041 998.5, filed 21 Sep. 2009, the content of which is incorporated here by reference.

BACKGROUND OF THE INVENTION

1. Field of the Invention

The invention is directed to a heat-sensitive recording material having a substrate which carries on its first side at least one heat-sensitive recording layer and on its second side a backcoat containing calcium carbonate. The heat-sensitive recording layer has at least one dye precursor and at least one color acceptor which react with one another in a color-forming manner under the action of heat.

2. Detailed Description of Prior Art

The stated object in WO99/14056 A1 is a backcoat having a good barrier effect with respect to substances used in offset printing and flexographic printing, particularly organic solvents, and with respect to plasticizers, oils and fats, is motivated by the desire to print on the back side of a heat-sensitive recording material in offset printing and flexographic printing. In order to meet the object stated therein, the backcoat of the known recording material has a mixture containing starch, an acrylate copolymer which does not include any styrene or vinyl acetate components and which has a film-forming temperature of less than 5° C., preferably less than 2° C., and an alkaline catalyst such as, e.g., calcium carbonate.

Accordingly, it is known from the above-cited publication to use the back side of heat-sensitive recording materials as a substrate for offset printing. Other recording materials known from the prior art have also proven successful as concerns the barrier effect against the chemicals employed in this connection. However, when aiming for high-quality pigment-containing backcoats, for example, for full-surface multicolor printing, severe difficulties were sometimes encountered in the past during the actual printing process with its requirements respecting the surface to be printed upon, since trouble-free and, therefore, efficient printing is hampered by deposits on the blanket. But the principle focus of criticism in previous proposals was the disappointing print image of pictures printed on the back side and the largely insufficient gloss of the back side. Accordingly, if multicolor printed images are to be applied to the back side of heat-sensitive recording materials with a quality approaching that of an art print, as is called for in the case of many commercial tickets, novel, previously unavailable solutions are needed.

SUMMARY OF THE INVENTION

Therefore, it is an object of one embodiment of the present invention to offer a heat-sensitive recording material having a backcoat that can be printed upon without problems with offset printing and flexographic printing methods and additionally, if possible, also with the inkjet printing method, and in which the backcoat allows an exquisite print image for art print reproduction.

In order to meet the above-stated object, a heat-sensitive recording material is proposed which has a substrate which carries on its first side at least one heat-sensitive recording layer having at least one dye precursor and at least one color acceptor, wherein dye precursor and color acceptor react with one another in a color-forming manner under the action of heat, and which carries on its second side a backcoat containing calcium carbonate, wherein the backcoat is formed of at least two layers, wherein a first layer is applied closer to the substrate and a second layer is applied farther from the substrate, and the first layer contains a first calcium carbonate, the second layer contains a second calcium carbonate differing from the first calcium carbonate.

BRIEF DESCRIPTION OF THE DRAWINGS

FIG. 1 is a heat-sensitive recording material.

DETAILED DESCRIPTION OF THE PREFERRED EMBODIMENTS

FIG. 1 discloses a heat-sensitive recording material 10 having a substrate 1. On a first side of substrate 1 is at least one heat-sensitive recording layer 2 having at least one dye precursor and at least one color acceptor. On a second side of the substrate 1, opposite the first side, there is a backcoat that is formed of at least two layers 4, 5. The first backcoat layer 5 is applied closer to the substrate 1 and a second backcoat layer 4 is applied farther from the substrate 1. In one embodiment, the second layer 4 contains hollow pigments 7. A pigmented intermediate layer 3 is applied between the substrate 1 and the heat-sensitive recording layer 2. A protective layer 6 is applied to the heat-sensitive recording layer 2.

The first layer of the backcoat 5 contains as pigment, most preferably as sole pigment, a preferably natural calcium carbonate having an average particle size preferably in a range from 1.35 μm to 2.1 μm, most preferably in a range from 1.4 μm to 1.8 μm. In the present case, the average particle size is determined by a Sedigraph 5100, Micromeritics GmbH, Erftstrasse 54, 41238 Mönchengladbach, Germany. Further, ideally 60% of the calcium carbonate particles should have a particle size of less than 2 μm.

Styrene-butadiene latex, ideally with added styrene acrylate copolymers and acrylic ester graft polymers, is preferably used as binder in the first layer of the backcoat 5.

The second layer of the backcoat 5 can contain, preferably as sole inorganic pigment, natural calcium carbonate or, particularly preferably, precipitated calcium carbonate with an average particle size preferably in a range from 0.85 μm to 1.25 μm, most preferably in a range from 0.9 μm to 1.2 μm. In the present case, the average particle size is again determined by the Sedigraph 5100. Accordingly, the average particle size of the calcium carbonate of the first layer of the backcoat differs from the average particle size of the calcium carbonate of the second layer of the backcoat. The respective preparations can also particularly preferably differ from one another in characterizing manner: preferably natural, ground calcium carbonate is contained in the first layer, and precipitated calcium carbonate is particularly preferably contained in the second layer.

With respect to the precipitated calcium carbonate that is particularly preferably used in the second layer of the backcoat 4, the particle shape is also important, it having been recognized that a flaky particle shape is advantageous for the subsequent gloss of the back side and, therefore, for a particularly plausible appearance of the back side of the heat-sensitive recording material according to one embodiment of the invention.

In addition to calcium carbonate, the second layer of the backcoat 4 additionally contains as pigment preferably organic hollow pigments 7, as they are called. It is particularly advantageous when the pigment mixture within the second layer of the backcoat 4 comprises 10 to 80 wt. %, preferably 35 to 50 wt. %, and most preferably 38 to 45 wt. %, of organic and 90 to 20 wt. %, preferably 65 to 50 wt. %, and most preferably 62 to 55 wt. % of calcium carbonate, wherein the percent by weight is based on the total proportion of pigment in the second layer of the backcoat 4.

A combination of (carboxy)methyl cellulose and styrene-butadiene latex, ideally with the addition of cornstarch, is preferred as binder for the second layer of the backcoat. Another possible binder for the second layer of the backcoat 4 is polyvinyl alcohol.

In particular, a roller doctor coater, knife coater, curtain coater, or air brush can be used for applying the two layers of the backcoat, knife coaters and particularly roller doctor coaters being most preferable. The basis weight of the first layer of the backcoat is preferably between 7 and 15 g/m$^2$ or, even better, between 8.5 and 11.5 g/m$^2$; the basis weight of the second layer of the backcoat is preferably between 10 and 2 g/m$^2$ and, even better, between 6 and 3 g/m$^2$.

Wet-on-wet application of the two layers 4, 5 can be carried out followed by drying; an application in which the first layer 5 is applied and dried and the second layer 4 is applied and dried only afterwards is also possible. This possibility is preferable in view of the glossiness achieved.

To form a particularly convincing appearance of the back side of the heat-sensitive recording material according to one embodiment of the invention, the back side is calendered after application and drying of both layers, wherein a line pressure in a range from 80 to 120 bar at a temperature of the heat-sensitive recording material at the calender input of 45° C. to 55° C. or, most preferably, a line pressure in a range from 110 to 180 bar at a temperature of the heat-sensitive recording material at the calender input of 30° C. to 45° C. has proven particularly advisable.

When using a calender having at least two press nips formed in each instance by a steel roller and a polymer roller, gloss values are achieved in a preferred range from 60 to 90%, most preferably in a range from 70 to 90%, measured at a reflection angle of 75% using Tappi 450 or ISO 2813.

According to a first embodiment variant, the heat-sensitive recording layer 2 having at least one dye precursor and at least one color acceptor, wherein the dye precursor and color acceptor react with one another in a color-forming manner under the action of heat, preferably has as color acceptor at least 33⅓ wt. %, most preferably 100 wt. %, of N-(p-toluenesulphonyl)-N'-3-(p-toluenesulphonyloxyphenyl)urea based on the total proportion of color acceptors in the heat-sensitive recording layer. Based on the total weight of the recording layer 2, the color acceptor then constitutes up to 32 wt. %, but preferably a proportion in a range from 15 to 30 wt. % and, better yet, between 18 and 28.5 wt. %, of the heat-sensitive recording layer.

N-(p-toluenesulphonyl)-N'-3-(p-toluenesulphonyloxyphenyl)urea, which is available as Pergafast® 201 from CIBA Speciality Chemicals Inc., can also be represented by the following formula (1), where the two $CH_3$ end molecules are often omitted in the literature:

Formula (1)

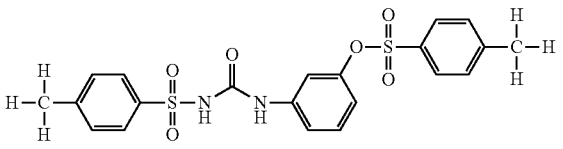

According to a second embodiment, the heat-sensitive recording layer 2 of the heat-sensitive recording material according to the invention has, instead of N-(p-toluenesulphonyl)-N'-3-(p-toluenesulphonyloxyphenyl)urea, other color acceptors particularly selected from the list comprising: 2,2-bis(4-hydroxyphenyl)propan, 4-[(4-(1-methylethoxy)phenyl)sulfonyl]phenol, 4-hydroxy-4'-isopropoxydiphenyl sulfone, 4,4'-dihydroxydiphenyl sulfone, 2,4'-dihydroxydiphenyl sulfone, N-(2-hydroxyphenyl)-2-[(4-hydroxyphenyl)thio]acetamide.

With respect to the heat-sensitive recording layer 2, it was recognized by the inventors with regard to the stated object that the recording layer can contain practically any known dye precursors, wherein combinations of a plurality of dye precursors are also possible. The following are particularly preferred as dye precursors:

3-dipentylamino-6-methyl-7-anilinofluoran,
3-diethylamino-6-methyl-7-anilinofluoran,
and most preferably
3-diethylamino-6-methyl-7-anilinofluoran,
3-dibutylamino-6-methyl-7-anilinofluoran,
3-(N-methyl-N-propyl)amino-6-methyl-7-anilinofluoran,
3-(N-ethyl-N-isoamyl)amino-6-methyl-7-anilinofluoran,
3-(N-methyl-N-cyclohexyl)amino-6-methyl-7-anilinofluoran,
3-(N-ethyl-N-tolyl)amino-6-methyl-7-anilinofluoran, and
3-(N-ethyl-N-tetrahydrofuryl)amino-6-methyl-7-anilinofluoran.

For commercial reasons, 3-dibutylamino-6-methyl-7-anilinofluoran is the most suitable dye precursor that is used singly or in combination with other dye precursors preferably selected from the dye precursors mentioned above.

To increase thermal responsiveness, the recording layer of the heat-sensitive recording material according to the invention can preferably also contain sensitizers, ideally with a melting point of 60° C. to 180° C., particularly preferably with a melting point of 80° C. to 140° C. Examples of sensitizers of this type are: benzyl-p-benzyloxy-benzoate, stearamide, N-methylol stearamide, p-benzylbiphenyl, 1,2-di(phenoxy)ethane, 1,2-di(m-methylphenoxy)ethane, m-terphenyl, dibenzyl oxalate, benzyl naphthyl ether, and diphenyl sulfone, wherein benzyl naphthyl ether, diphenyl sulfone, 1,2-di(m-methylphenoxy)ethane, and 1,2-di(phenoxy)ethane are preferred.

Further, another most preferable sensitizer is 2-(2H-benzotriazol-2-yl)-p-cresol according to the following formula (2):

Formula (2)

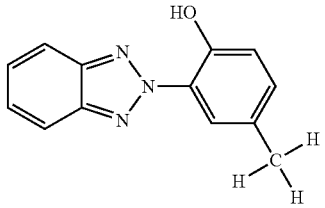

2-(2H-benzotriazol-2-yl)-p-cresol according to Formula (2), available as Tinuvin® from CIBA Speciality Chemicals Inc., can be used as the sole sensitizer or in combination with the sensitizers mentioned above in the recording layer of the recording material according to the invention.

Suitable binders for incorporating in the heat-sensitive recording layer 2 are, for example, water-soluble binders such as starch, hydroxy ethyl cellulose, methyl cellulose, carboxymethyl cellulose, gelatins, casein, polyvinyl alcohols, modified polyvinyl alcohols, sodium polyacrylates, acrylamide/acrylate copolymers, acrylamide/acrylate/methacrylate terpolymers, alkali metal salts of styrene maleic acid anhydride copolymers or ethylene maleic acid anhydride copolymers, which can be used singly or in combination; also, water-insoluble latex binders such as styrene-butadiene copolymers, acryl nitrile butadiene copolymers, and methyl acrylate butadiene copolymers can be used as binders for incorporation in the heat-sensitive recording layer. Within the meaning of the present invention, polyvinyl alcohol, singly or in combination with acrylate copolymers, is a particularly preferred binders and is incorporated in the heat-sensitive recording layer in a proportion of 12 to 27.5 wt. % based on the total weight of the recording layer.

To prevent sticking to a thermal head and to prevent excessive wear of the thermal head, the coating compound for forming the heat-sensitive recording layer can also contain lubricants and release agents such as metal salts of higher fatty acids, for example, zinc stearate, calcium stearate and waxes such as, e.g., paraffin, oxidized paraffin, polyethylene, polyethylene oxide, stearamide, and castor wax. Other constituents of the recording layer are, for example, pigments, preferably inorganic pigments such as aluminum (hydr)oxide, silicic acid, and calcium carbonate. Calcium carbonate which is preferably incorporated in the recording layer in a quantity of from 10 to 28 wt. % based on the total weight of the recording layer is preferred.

It is preferable that a permanent color image or text image can be formed in the recording layer under the action of heat.

The basis weight of the heat-sensitive recording layer 2 is preferably between 2.5 g/m$^2$ and 12 g/m$^2$, particularly preferably between 3 g/m$^2$ and 6.5 g/m$^2$. Knife coating units and (roller) doctor coating units, curtain coaters, and air brushes can be used in particular as coating devices for applying the heat-sensitive recording layer.

The coating compound used to form the recording layer 2 is preferably aqueous. The subsequent drying of the coating compound can be carried out by microwave irradiation. It is also conventional and has proven successful to apply heat such as by hot-air floatation dryers or contact dryers. A combination of the aforementioned drying methods is also conceivable.

A pigmented intermediate layer 3 is advisably arranged between the heat-sensitive recording layer 2 and the substrate 1 of the heat-sensitive recording material 10 according to the invention. Further, when the intermediate layer 3 is applied in a preferred embodiment form by leveling coating devices such as, e.g., roller coating units, knife coating units, or (roller) doctor coating units, the intermediate layer 3 can contribute in a positive manner to the leveling of the substrate surface so that the required amount of coating compound to be applied for the heat-sensitive recording layer 3 is reduced. A preferred range for the basis weight of the intermediate layer 3 between 5 g/m$^2$ and 20 g/m$^2$ or, better still, between 7 g/m$^2$ and 12 g/m$^2$, has proven successful.

When inorganic, oil-absorbing pigments are incorporated in the intermediate layer 3 situated between the recording layer 2 and substrate 1, these pigments can absorb the wax constituents of the heat-sensitive recording layer that are liquefied by the heating effect of the thermal head during formation of the text image and accordingly promote an even more reliable and faster functioning of the heat-induced recording, which is why an embodiment form of this kind is preferred.

Particularly preferred inorganic pigments for the pigmented intermediate layer are calcined china clay singly or in combination with other inorganic pigments selected from the list comprising calcium carbonate, silicon oxide, bentonite, aluminum oxide and, particularly for this purpose, boehmite.

Tests have shown that it can also be very advantageous to incorporate organic pigments in the pigmented intermediate layer. The reason for this is that organic pigments of this kind are highly conducive to a high heat reflectivity of the intermediate layer. The organic hollow pigments, as they are called, which are arranged in an intermediate layer of a heat-sensitive recording material have air in their interior, which is a good heat insulator. The intermediate layer which is optimized in this way as a heat reflection layer enhances the responsiveness of the recording layer to heat, which appreciably increases the resolution of the heat-sensitive recording material and particularly the dynamic print density so that the maximum printing speed of the thermal printer on the recording material according to the invention is increased at the same time.

The quantitative ratio of organic to inorganic pigment is a compromise between the effects brought about by the two types of pigment, and one which is met in a particularly advantageous manner when the pigment mixture is composed of 5 to 30 wt. % or, better, 8 to 20 wt. % of organic pigment to 95 to 70 wt. % or, better, 92 to 80 wt. % of inorganic pigment. Pigment mixtures of different organic pigments are also possible. Calcined china clay is preferred as inorganic pigment—also, in this case, in a mixture with organic pigments—without limiting thereto. Also, with respect to the inorganic pigments, mixtures of different inorganic pigments are also possible in this case.

In addition to the inorganic pigments and possibly organic pigments, the pigmented intermediate layer contains at least one binder, preferably based on a synthetic polymer. For example, styrene-butadiene latex delivers especially good results. The use of a synthetic binder with the addition of at least one natural polymer, preferably starch, represents a particularly suitable embodiment form. Further, it was determined in tests with inorganic pigments that a particularly suitable embodiment form is achieved with a binder to pigment ratio in the pigmented intermediate layer between 3:7 and 1:9 with respect to percent by weight.

A protective layer 6 is preferably applied to the heat-sensitive recording layer 2. It is most preferable when the protective layer has as binder at least 60 wt. % of diacetone-modified polyvinyl alcohol based on the total proportion of binder in the protective layer.

In a first possible embodiment form, the protective layer 6 of the heat-sensitive recording material 10 according to one embodiment of the invention has, in addition to the diacetone-modified polyvinyl alcohol, additional binders, particularly mixtures of different carboxyl group-modified or silanol-modified polyvinyl alcohols. They will then make up a maximum of 40 wt. %, preferably a maximum of 15 wt. % based on the total proportion of binder in the protective layer. In a second possible embodiment form, the protective layer 6 of the heat-sensitive recording material 10 according to the invention has exclusively diacetone-modified polyvinyl alcohol as binder. Particularly when diacetone-modified polyvinyl alcohol is the sole binder in the protective layer covering the heat-sensitive recording layer, it is particularly preferable when the binder proportion in the protective layer is in a range from 35 to 65 wt. % based on the total weight of the protective layer 6.

Suitable crosslinking agents in the protective layer 6 are particularly those selected from the following group: boric acid, polyamine, epoxy resin, dialdehyde, formaldehyde oligomers, epichlorohydrin resin, adipic acid dihydrazide, dimethyl urea, and melamine formaldehyde. Mixtures of different crosslinking agents are also possible.

The ratio by weight percent of binder, particularly diacetone-modified polyvinyl alcohol, to crosslinking agent in the protective layer 6 preferably ranges from 20:1 to 5:1, particularly preferably from 12:1 to 7:1

Particularly good results were achieved when the protective layer 6 preferably contained an inorganic pigment in addition. It is especially recommended that the inorganic pigment is selected from the group including silicon dioxide, aluminum hydroxide, bentonite, calcium carbonate, china clay, or a mixture of these inorganic pigments. A ratio of pigment—and in this case, particularly preferably china clay—to modified polyvinyl alcohol is adjusted within a range from 1:1.5 to 1:4.5 based on the respective weight percentage of pigment and polyvinyl alcohol in the protective layer.

Roller doctor coating units, knife coating units, curtain coaters, or air brushes can be used in particular as a coating device for applying the protective layer covering the heat-sensitive recording layer. The basis weight of the protective layer is preferably between 1.0 g/m$^2$ and 3.0 g/m$^2$ or, better still, between 1.6 g/m$^2$ and 2.3 g/m$^2$.

Foils and paper and, in this case, most preferably a base paper with stock sizing are suitable as substrate for the heat-sensitive recording material 10 proposed herein, but without being limited to this in any way.

In a particularly preferred embodiment, the substrate 1 is a paper web with a proportion of recycled fibers of at least 70 wt. % based on the total fiber proportion in the paper web.

The invention will be described more fully with reference to the following two examples according to the invention and four comparison examples.

In order to form a paper web, as substrate, which is identical for all the examples, a paper pulp of bleached eucalyptus cellulose and softwood cellulose is added together with water to a blend chest. Additional constituents of the pulp include resin size for stock sizing in quantities of 0.6 wt. % (absolutely dry) based on the total weight of the pulp and, optionally, additional conventional additives such as, e.g., pigments and/or optical brighteners. The finished pulp is then fed to a Fourdrinier paper machine in which it is processed to form a paper web with a basis weight of 69 g/m$^2$.

Online within the paper machine, a pigmented intermediate layer with a basis weight of 9 g/m$^2$ is applied to the front side of the paper web using a roller doctor. The coating compound for forming the intermediate layer has: a pigment mixture of hollow pigment and calcined china clay with a ratio of hollow pigment to calcined china clay of 1:4 based on percent by weight, styrene-butadiene latex as binder, starch as co-binder and additional auxiliaries.

After lightly calendering the paper web, which is now provided with the pigmented intermediate layer, a heat-sensitive recording layer having a basis weight of 4.8 g/m$^2$ is applied to this intermediate layer in a separate coating machine using a roller doctor. The coating compound for forming the heat-sensitive recording layer—identical in all of the examples—has the following formulation:

40 wt. %: calcium carbonate (pigment).

12.5 wt. %: polyvinyl alcohol (binder), 5 wt. %: zinc stearate (lubricant), 9 wt. %: 3-dibutylamino-6-methyl-7-anilinofluoran (OBB-2, dye precursor), 18 wt. %: N-(p-toluenesulphonyl)-N'-3-(p-toluenesulphonyloxyphenyl)urea according to Formula (1), i.e., Pergafast® 201 by CIBA Speciality Chemicals Inc. (color acceptor), 15 wt. %: benzyl naphthyl ether (BNE, sensitizer).

A protective layer completely covering the heat-sensitive recording layer and having a basis weight of 2.0 g/m$^2$ is applied to the heat-sensitive recording layer within one and the same pass through the coating machine using an airbrush application unit. The coating compound for forming the protective layer has the following formulation which is the same for all of the examples:

95 wt. %: diacetone-modified polyvinyl alcohol (binder), 5 wt. %: adipic acid dihydrazide (crosslinking agent).

A paper web produced as was described above in the prior four paragraphs is provided with different backcoats with one or two passes of a roller doctor coating unit to obtain samples of heat-sensitive recording materials of the two examples according to the invention on one hand and four comparison examples on the other hand. The following backcoats are applied:

TABLE 1

| | Backcoat . . . | Formulation used |
|---|---|---|
| Example 1 according to the invention | . . . , first layer, application: 10 g/m$^2$ | Formulation 1 |
| | . . . , second layer, application: 3.2 g/m$^2$ | Formulation 2 |
| Example 2 according to the invention | . . . , first layer, application: 10 g/m$^2$ | Formulation 1 |
| | . . . , second layer, application: 3.2 g/m$^2$ | Formulation 3 |
| Comparison example 1 | . . . , first layer, application: 10 g/m$^2$ | Formulation 1 |
| | . . . , second layer | — |
| Comparison example 2 | . . . , first layer, application: 10 g/m$^2$ | Formulation 1 |
| | . . . , second layer, application: 3.2 g/m$^2$ | Formulation 1 |
| Comparison example 3 | . . . , first layer | — |
| | . . . , second layer | — |
| Comparison example 4 | . . . , first layer, application: 15 g/m$^2$ | Formulation 2 |
| | . . . , second layer | — |

The following composition is used as formulation 1:

88.1 wt. %: natural calcium carbonate; average particle size 1.6 μm (determined by Sedigraph 5100), 8.8 wt. %: styrene-butadiene latex (binder), 0.7 wt. %: styrene-acrylate copolymer (co-binder), 2.0 wt. %: polyacrylamide copolymer (thickener), 0.4 wt. %: auxiliaries: optical brighteners, antifoaming agent.

The following composition is used as formulation 2:

43.9 wt. %: precipitated calcium carbonate; average particle size 1.1 μm (determined by Sedigraph 5100), 30.5 wt. %: organic hollow pigments, 22.3 wt. %: styrene-butadiene latex (binder 1), 0.9 wt. %: carboxymethyl cellulose (binder 2), 2.4 wt. %: auxiliaries: waxes, optical brighteners, antifoaming agent.

The following composition is used as formulation 3:

51.0 wt. %: natural calcium carbonate; average particle size 0.9 μm (determined by Sedigraph 5100), 32.0 wt. %: organic hollow pigments, 2.5 wt. %: polyvinyl alcohol (binder 1)

12.5 wt. %: styrene-butadiene latex (binder 2), 2.0 wt. %: auxiliaries: waxes, optical brighteners, antifoaming agent.

It will be seen from Table 1 in connection with the various formulations that exclusively samples of Examples 1 and 2 according to the invention have a backcoat comprising two layers having different calcium carbonates in the two layers. The dissimilarity of the calcium carbonates in the two layers consists particularly in that, on the one hand, the average particle size of the respective calcium carbonates in the two layers differs, i.e., the particle size in the first layer is greater than in the second layer, and on the other hand, in Example 1 according to one embodiment of the invention, that natural calcium carbonate is present in the first layer, whereas precipitated calcium carbonate is present in the second layer. Samples of Comparison Examples 1 and 4 show only a single-layer backcoat; samples of Comparison Example 3 have no backcoat at all. The samples of Comparison Example 2 have a backcoat comprising two layers, but the two layers have the same calcium carbonate.

After applying one or two layers for the backcoat, the samples of all of the examples are calendered again; the calender used for this purpose has two nips with a center steel roller and two contacting polymer rollers; a line pressure of 150 bar is adjusted in each nip. The temperature at the calender inlet measures 36° C.

Gloss values based on ISO 2813 (reflection angle: 75°) are recorded for the samples of all of the examples, but the averages of the measured gloss values for the samples in longitudinal direction on the one hand and transverse direction on the other hand are used as basis for further considerations: the averages calculated in this way are shown in Table 2. Subsequently, a printout sample having all printing colors is printed on the back side of a first portion of the samples using an Epson Stylus Photo 950 inkjet printer (printer driver: 360 dpi), the remaining second portion of samples is provided with offset printing on the back side. Each of the finished print images is visually inspected. The results of the visual assessment are given in Table 2.

TABLE 2

| | Gloss, reflection angle 75° | Offset printing, visual assessment | Inkjet printing, visual assessment |
|---|---|---|---|
| Example 1 | 77 | good | good |
| Example 2 | 70 | good | good |
| Comparison example 1 | 15 | medium | medium |
| Comparison example 2 | 20 | barely good | medium |
| Comparison example 3 | <10 | mottling, faint | poor |
| Comparison example 4 | 72 | mottling | medium |

The examples prove the superiority of the backcoat according to the invention having at least two layers, wherein a first layer is applied closer to the substrate and a second layer is applied farther from the substrate, and the first layer contains a first calcium carbonate, the second layer contains a second calcium carbonate differing from the first calcium carbonate.

Only in the above case of the invention is the gloss significantly higher and the print image convincing; the comparison examples are poorer with respect to both gloss and print image.

The basis weight and weight percentage (wt. %) indicated in the description, in the examples associated with the description, and in the claims are based on the absolutely dry weight.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A heat-sensitive recording material comprising:

a substrate having a first side and a second side opposite the first side;

at least one heat-sensitive recording layer having at least one dye precursor and at least one color acceptor arranged on the first side of the substrate, wherein the dye precursor and the color acceptor react with one another in a color-forming manner under the action of heat;

a backcoat containing calcium carbonate arranged on the second side of the substrate, the backcoat having at least two layers, wherein a first backcoat layer containing a first calcium carbonate is applied closer to the substrate and a second backcoat layer containing a second calcium carbonate that differs from the first calcium carbonate is applied farther from the substrate.

2. The heat-sensitive recording material according to claim 1, wherein the first calcium carbonate differs from the second calcium carbonate with respect to average particle size.

3. The heat-sensitive recording material according to claim 1, wherein the first calcium carbonate differs from the second calcium carbonate with respect to preparation.

4. The heat-sensitive recording material according to claim 1, wherein the second backcoat layer contains first hollow pigments.

5. The heat-sensitive recording material according to claim 1, wherein the second backcoat layer contains a combination of (carboxy)methyl cellulose and styrene-butadiene latex as a binder.

6. The heat-sensitive recording material according to claim 1, further comprising a pigmented intermediate layer arranged between the substrate and the at least one heat-sensitive recording layer.

7. The heat-sensitive recording material according to claim 6, wherein the pigmented intermediate layer contains a mixture of calcined china clay and second hollow pigments as pigment.

8. The heat-sensitive recording material according to claim 1, wherein the at least one heat-sensitive recording layer has as color acceptor at least 33⅓ wt. % of N-(p-toluenesulphonyl) -N'-3-(p-toluenesulphonyloxyphenyl)urea based on a total proportion of color acceptors in the at least one heat-sensitive recording layer.

9. The heat-sensitive recording material according to claim 1, further comprising a protective layer applied to the at least one heat-sensitive recording layer.

10. The heat-sensitive recording material according to claim 9, wherein the protective layer contains diacetone-modified polyvinyl alcohol as binder.

11. The heat-sensitive recording material according to claim 2, wherein the second backcoat layer contains hollow pigments.

12. The heat-sensitive recording material according to claim 11, wherein the second backcoat layer contains a combination of (carboxy)methyl cellulose and styrene-butadiene latex as a binder.

13. The heat-sensitive recording material according to claim 12, further comprising a pigmented intermediate layer arranged between the substrate and the at least one heat-sensitive recording layer.

14. The heat-sensitive recording material according to claim 13, wherein the pigmented intermediate layer contains a mixture of calcined china clay and second hollow pigments as pigment.

15. The heat-sensitive recording material according to claim 14, wherein the at least one heat-sensitive recording layer has as color acceptor at least 33⅓ wt. % of N-(p-toluenesulphonyl) -N'-3-(p-toluenesulphonyloxypheny)urea based on a total proportion of color acceptors in the at least one heat-sensitive recording layer.

16. The heat-sensitive recording material according to claim 15, further comprising a protective layer applied to the at least one heat-sensitive recording layer.

17. The heat-sensitive recording material according to claim 16, wherein the protective layer contains diacetone-modified polyvinyl alcohol as binder.

* * * * *